US009359832B2

(12) United States Patent
Jenkins et al.

(10) Patent No.: US 9,359,832 B2
(45) Date of Patent: Jun. 7, 2016

(54) MECHANICAL BENDING WEAK LINK

(75) Inventors: Peter Jenkins, Nesbru (NO); Harald Holden, Asker (NO); Ola Ystgaard, Oslo (NO)

(73) Assignee: STATOIL PETROLEUM AS, Stavanger (NO)

( * ) Notice: Subject to any disclaimer, the term of this patent is extended or adjusted under 35 U.S.C. 154(b) by 656 days.

(21) Appl. No.: 13/699,269

(22) PCT Filed: May 11, 2011

(86) PCT No.: PCT/EP2011/057608
§ 371 (c)(1),
(2), (4) Date: Feb. 12, 2013

(87) PCT Pub. No.: WO2011/144512
PCT Pub. Date: Nov. 24, 2011

(65) Prior Publication Data

US 2013/0133895 A1 May 30, 2013

(30) Foreign Application Priority Data

May 21, 2010 (NO) ..... 20100749

(51) Int. Cl.
*E21B 17/06* (2006.01)
*E21B 33/038* (2006.01)

(52) U.S. Cl.
CPC ..... *E21B 17/06* (2013.01); *E21B 33/038* (2013.01)

(58) Field of Classification Search
CPC ..... E21B 17/06; E21B 33/038; E21B 17/017; E21B 41/0007
USPC ..... 166/363, 364, 345; 285/1, 922
See application file for complete search history.

(56) References Cited

U.S. PATENT DOCUMENTS

| | | | | |
|---|---|---|---|---|
| 3,383,122 | A * | 5/1968 | Richardson | 285/1 |
| 3,516,488 | A | 6/1970 | Joubert et al. | |
| 4,057,268 | A | 11/1977 | Sicard | |
| 4,153,112 | A | 5/1979 | Luke | |
| 4,269,226 | A * | 5/1981 | Allread | 137/614 |
| 4,277,875 | A | 7/1981 | Worrell | |
| 4,431,215 | A | 2/1984 | Moyer | |
| 4,533,161 | A * | 8/1985 | Burke et al. | 285/1 |
| 5,873,677 | A * | 2/1999 | Davies et al. | 405/195.1 |
| 6,336,508 | B1 | 1/2002 | Guinn | |

(Continued)

FOREIGN PATENT DOCUMENTS

| | | |
|---|---|---|
| DE | 2832220 A1 | 1/1980 |
| NO | 324137 B1 | 9/2007 |

(Continued)

*Primary Examiner* — James G Sayre
(74) *Attorney, Agent, or Firm* — Birch, Stewart, Kolasch & Birch, LLP

(57) ABSTRACT

A method and a safety device are disclosed for protection of well barrier(s) against excessive bending moments from a riser. The safety device is arranged to detect critical bending loads in or in between the well barrier(s) and/or riser, and may include: a device for detecting changes in a curvature between a load carrying riser pipe and an unloaded stiff body attached to or in the vicinity of the riser pipe, said device for detecting changes in the curvature being arranged to measure a relative distance between the load carrying riser pipe and the unloaded stiff body, and a device for triggering disconnection of a releasable riser connector when the distance between the load carrying riser pipe and the unloaded stiff body reaches a predefined critical distance.

16 Claims, 13 Drawing Sheets

(56) References Cited

U.S. PATENT DOCUMENTS

| | | | | |
|---|---|---|---|---|
| 6,557,637 | B1 * | 5/2003 | Dore et al. | 166/338 |
| 6,568,476 | B1 | 5/2003 | Andersen | |
| 7,934,376 | B2 * | 5/2011 | Biester | 60/405 |
| 8,403,057 | B2 * | 3/2013 | Rodgers et al. | 166/360 |
| 8,783,357 | B2 * | 7/2014 | Coppedge et al. | 166/340 |
| 2006/0065401 | A1 | 3/2006 | Allen et al. | |
| 2008/0105435 | A1 * | 5/2008 | Inderberg | 166/363 |
| 2011/0178730 | A1 * | 7/2011 | Mangal et al. | 702/43 |
| 2011/0284237 | A1 * | 11/2011 | Baugh | 166/365 |
| 2012/0067589 | A1 * | 3/2012 | Fenton | 166/340 |
| 2013/0269946 | A1 * | 10/2013 | Dziekonski | 166/345 |

FOREIGN PATENT DOCUMENTS

| | | | |
|---|---|---|---|
| NO | 327407 | B1 | 6/2009 |
| SU | 579946 | A3 | 11/1977 |
| SU | 712037 | A3 | 1/1980 |
| WO | WO 03/064803 | A2 | 8/2003 |
| WO | WO 03/064809 | A1 | 8/2003 |

* cited by examiner

Tc = Tension capacity
Mc = Moment capacity

A)

B)

C)

MECHANICAL BENDING WEAK LINK

TECHNICAL FIELD OF INVENTION

The present invention relates to a safety device for emergency disconnect of a riser or hose, typically in relation with well intervention riser systems, completion/work over (C/WO) riser systems etc. The technology/concept may also be applicable for production risers including flexible risers and also offshore offloading systems and other riser or hose systems in use offshore today.

BACKGROUND

The conventional riser disconnect systems are based on either an operator initiated emergency disconnect system requiring the active intervention of an operator (by the push of a button) and automatic disconnect systems based on a weak link placed in the riser system which is designed to fail mechanically in an emergency scenario before any other critical components fail. Such disconnect systems are typically referred to as "weak links".

The key purpose of a weak link is to protect the well barrier(s) or other critical structure(s) interfacing the riser in accidental scenarios, such as heave compensator lock-up or loss of rig position which may be caused by loss of an anchor (dragged anchor), drift-off, where the rig or ship drifts off location because the rig or ship loses power, or drive-off, which is a scenario where the dynamic positioning system on the rig or ship fails for any reason causing the ship to drive off location in any arbitrary direction. In such accidental scenarios operators will have very limited time to recognize that an accident is happening and to trigger a release of the riser from the well or other critical structure(s) attached to the riser. In such accidental scenarios where the operators do not have reasonable time to react to an accident the weak link shall ensure that the integrity of the well barrier(s) or other critical interfacing structure(s) is/are protected.

When a riser is connected to a wellhead, a X-mas tree (or a lower riser package with a X-mas tree) is landed and locked onto the wellhead. The riser system is then fixed to the well on the seabed in the lower end. The upper end of the riser is typically suspended from a so-called heave compensator 1 and/or riser tensioning system in the upper end as illustrated in FIG. 1. The riser tensioning system applies top tension to the riser 2 and is connected to a heave compensator 1 which compensates for the relative heave motion between the vessel 3 (e.g. a rig or a ship) moving in the waves and the riser fixed to the seabed 4. The heave compensator system 1 is typically based on a combination of hydraulic pistons and pressurized air accumulators (not shown). The hydraulic pistons are driven actively up and down by a hydraulic power unit in order to compensate for the vertical motion of the vessel 3 in the waves. The air accumulators are connected to the same system and are used to maintain a relatively constant tension in the system. This is done by suspending the risers from cylinders resting on a pressurized air column, where the pressure is set according to the load in the system. The volume of the air accumulators and the stroke of the cylinders will then define the motion hysteresis and therefore the tension in the system as the vessel 3 moves vertically in the waves.

A compensator lock-up refers to a scenario where the heave compensation system fails, causing the heave compensator cylinders to lock and thereby failing to compensate for the heave motion between riser 2 and vessel 3, ref. FIG. 2. This may result in snag loads and excessive tension forces on the riser 2. Such snag loads may cause damage to well barrier(s) 5 or other interfacing structure(s). A weak link in the riser 2 will, when properly designed, protect the well barrier(s) 5 from damage in case of a compensator lock-up occurring.

Loss of position occurs when the vessel 3 fails to maintain its position within defined boundaries above the wellhead. Anchored vessels 3 usually experience loss of position caused by loss of one or more anchors. For dynamically positioned (DP) vessels, loss of position is normally caused by DP failure or by operator error causing the vessel 3 to drive-off from its intended position. In a drift-off scenario the vessel either does not have sufficient power to stay in its position given the current weather conditions, or vessel power is lost and the vessel will drift off in the direction of the wind, waves and currents. All such accidental scenarios result in excessive vessel 3 offset relative to well barrier(s) 5, ref. FIG. 3. When the position of the vessel moves outside the allowable boundaries, the resulting riser angle $\alpha$ in combination with riser tension will induce high bending moments in the lower and upper part of the riser 2. Furthermore as the relative distance between the vessel 3 and the well barrier(s) 5 on the seabed increases, the heave compensator cylinder will stroke out to compensate an otherwise increase in tension. Subsequently the heave compensator 1 will stroke out, leading to a rapid increase in the riser tension. When this occurs the relative angle $\alpha$ between the well barrier(s) 5 on the seabed 4 and the vessel 3 will have increased significantly and the rapid tension increase will cause high bending moments in the well barrier(s) 5.

To protect the well barrier(s) 5 in the mentioned accidental scenarios, a weak link needs to disconnect the riser 2 from the well barrier(s) 5 prior to exceeding the well barrier(s) 5 capacity in bending, ref. FIG. 5.

Exceeding the load capacity of the well barrier(s) 5 may involve damage of the well head, damage inside the well, damage on the riser 2 etc., all of which are considered to be serious accidental scenarios with high risk towards personnel and the environment.

Damage of the a well barrier(s) 5 may result in costly and time consuming repair work, costly delays due to lack of progress in the operation, and last, but not least, environmental and human risks in the form of pollution, blow-outs, explosions, fires, etc. The ultimate consequence of well barrier damage is a full scale subsea blow-out, with oil and gas from the reservoir being released directly and uncontrollably into the ocean. If the down-hole safety valve should fail or be damaged in the accident, there are no more means of shutting down the well without drilling a new side well for getting into and plugging the damaged well.

The challenges with existing weak link designs are related to the combination of fulfilling all design requirements (safety factors, etc.) during normal operation of the system, and at the same time ensuring reliable disconnect of the system in an accidental scenario.

The most common weak link concepts today rely on structural failure in a component or components. Typical designs involve a flange with bolts that are designed to break at a certain load, or a pipe section that is machined down over a short length to cause a controlled break of the riser in that location.

Most conventional weak links that are in use today only rely on tension forces, i.e. a given weak link is designed to break at a certain, pre-defined tension load. However, the emergency situations that arise do not involve tension forces alone. In the case of e.g. a drift-off, there will be significant bending moments introduced into the well barrier(s) 5 in addition to the tension forces. Even in a heave compensator lock-up scenario, bending moments acting on the well barrier(s) 5 may be significant due to the rig/vessel offset within the allowable operation window. It is not uncommon that the weather window for an operation is limited because the weak link can only accommodate a certain vessel offset in normal operation. Vessel station keeping ability above the well will be reduced with increasing winds and waves and normal variations in the position of the rig above the well will increase. If the offset exceeded a certain limit the weak link will not protect the well barrier(s) 5 in case of a heave compensator lock-up. Therefore, the ability of the weak link to fail due to bending may affect the weather window of the operation.

FIG. 4 illustrates the challenges linked to designing a weak link which is based on structural failure, e.g. the conventional breaking of weakened flange bolts or the like. The illustration shows a system where the nominal system tension in the weak link is 100 T (1 T=1 ton=1000 kg). The system shall work under pressure and the end cap effect of the pressure increases the tension to more than 200 T which the weak link needs to be designed for. In the design of the weak link, safety factors and spread in material properties has to be allowed for thus increasing the actual capacity of the part to more than 400 T. The weak link will normally also have to accommodate a certain bending moment in normal operation, which in the illustration mentioned above, has increased the structural capacity of the weak link to around 500 T. This means that in the example above, a weak link designed for a maximum operational tension of 100 T and a given bending moment, cannot be designed with a breaking load less than 500 T. In some cases the gap between design load and the minimum possible breaking load is greater than the allowable capacity in the well barrier(s), thus requiring a reduction in the operational capacities, which again reduces the operational envelopes. As the examples shows, the fact that the weak link shall be designed for full pressure, but at the same time shall work as a weak link when there is no pressure in the system, will for a high pressure system contribute significantly to the gap between the operational design load and the minimum breaking load in a weak link based on structural failure.

In additional, to the technical challenges related to existing weak link solutions based on structural failure, there are also schedule and cost challenges related to the conventional systems. A weak link based on structural failure requires a comprehensive qualification program for each project and typically imposes stringent requirements on material deliveries to control material properties of the parts designed to fail. These qualification programs and the additional requirements for particular material properties are often a challenge with respect to project schedules.

FIG. 5 shows a typical capacity curve for combined loading for well barrier(s) 5 being defined by a straight line along which all safety factors in the well barrier design have been fully utilized. This line does not represent the structural failure of the well barrier(s), but indicates the calculated allowable capacity of the well barrier(s) 5. If the combined loads exceed this line there is no guarantee for the integrity of the well barrier(s), and it is likely that the barrier(s) is(are) damaged and possible leaks may occur.

FIG. 6 illustrates how the loads in the riser 2 and in the well barrier(s) 5 develop in a loss of position scenario. When the rig 3 loses its position the load in the riser 2 will initially remain constant, because the heave compensator will stroke out to maintain a constant load in the riser. Once the heave compensator 1 strokes out, the tension in the riser 2 will increase rapidly as shown in the upper load diagram. The load in the well barrier(s) 5 will also remain close to constant while the heave compensator 1 strokes out (there will be some increase in the bending loads in the barrier(s)) and when the heave compensator 1 stops the axial load in the riser 2 will increase rapidly causing very high bending loads in the well barrier(s) 5. In such accidental scenarios existing weak links relying on structural failure in a riser component will typically reach its structural capacity curve long after having exceeded the design load capacity curve of the well barrier(s).

OBJECTS OF THE INVENTION

It is an aim of the present invention to provide a reliable, autonomous device which will protect the integrity of the well barrier(s) in any accidental scenario which could impose excessive bending moments onto the well barrier(s) 5, and which could damage the well barrier(s).

It is an aim of the present invention to provide a device and method for safe, reliable and predictable disconnect in various kinds of riser applications, e.g. drilling riser systems, well intervention risers systems, completion/work over (C/WO) riser systems, flexible production risers and offloading hoses, etc.

It is a further aim of the present invention to provide a device and method for safe, reliable and predictable disconnect in various kinds of riser and hose applications, wherein the device and method provide an increased operating envelope for the riser.

It is yet a further aim of the present invention to provide a device and method that fulfills all design requirements (safety factors, etc.) during normal operation, while at the same time ensuring reliable disconnect of the riser system in an accidental scenario leading to excessive bending moments in the well barrier(s) or other critical component(s).

It is a possible aim of the present invention to provide a safety device intended to be used in combination with existing weak link designs which are designed to protect the well barrier(s) against excessive axial loading.

Yet another possible aim of the invention is to provide a weak link where the release is not dependent to any kind of mechanical failure in the weak link, thus significantly reducing the need for project specific qualification programs to document release load.

Another possible aim of the invention is to provide a weak link where the release limit is defined by the curvature in the riser pipe, and where the limiting curvature can easily be adjusted thereby significantly reducing time with respect to qualifying the device for one specific project.

SUMMARY OF THE INVENTION

These and other aims are achieved by a safety device according to the independent claim 1, and a method according to the independent claim 8. Further advantageous features and embodiments are set out in the dependent claims.

SHORT DESCRIPTION OF THE DRAWINGS

The following is a detailed description of advantageous embodiments, with reference to the figures, where:

FIG. 1 shows a vessel 3 during a workover operation, where a rigid riser 2 is suspended from a heave compensator 1 on the rig and is rigidly attached to a wellhead (well barrier(s) 5) on the seabed 4. The heave compensator 1 strokes up and down to compensate for the heave motion of the vessel 3 in the waves.

Figure 1:
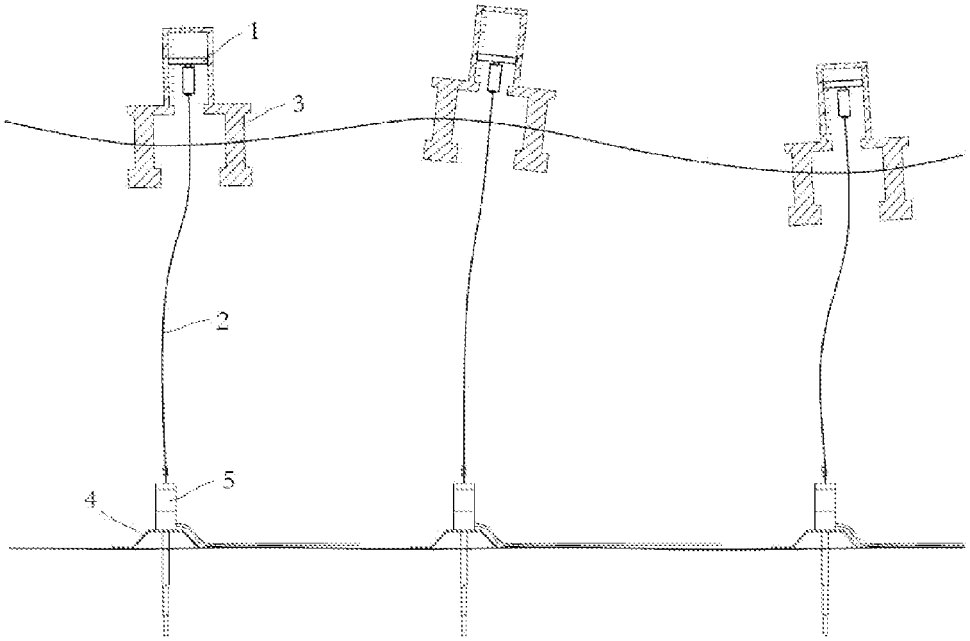
Figure 2:
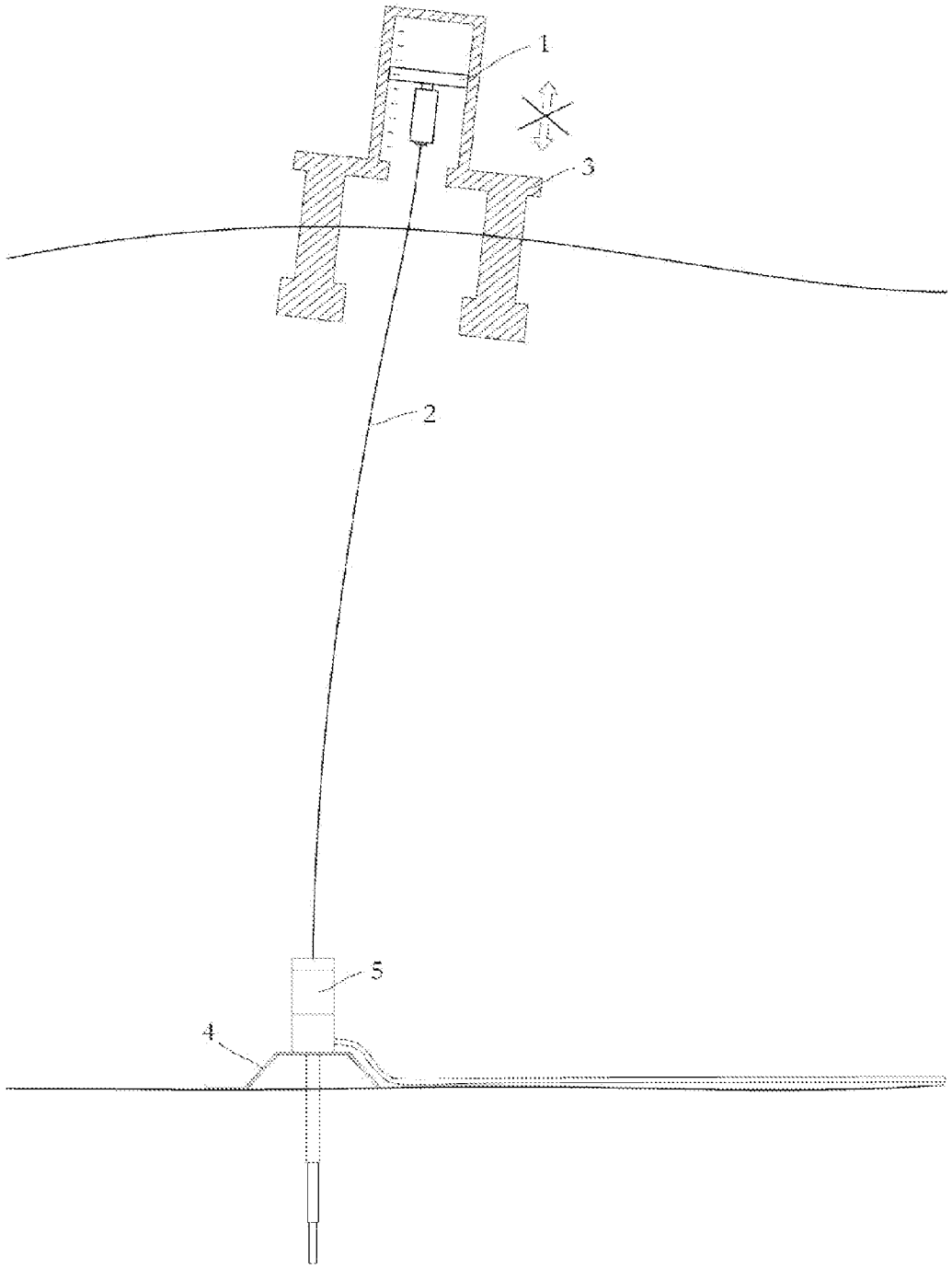
FIG. 2 illustrates the accidental scenario referred to as "heave compensator lock-up", causing a tension increase in the riser 2 when the waves lifts the vessel upward. The rapid increase in riser tension will typically result in excessive axial loading of the well barrier(s) 5.
Figure 3:
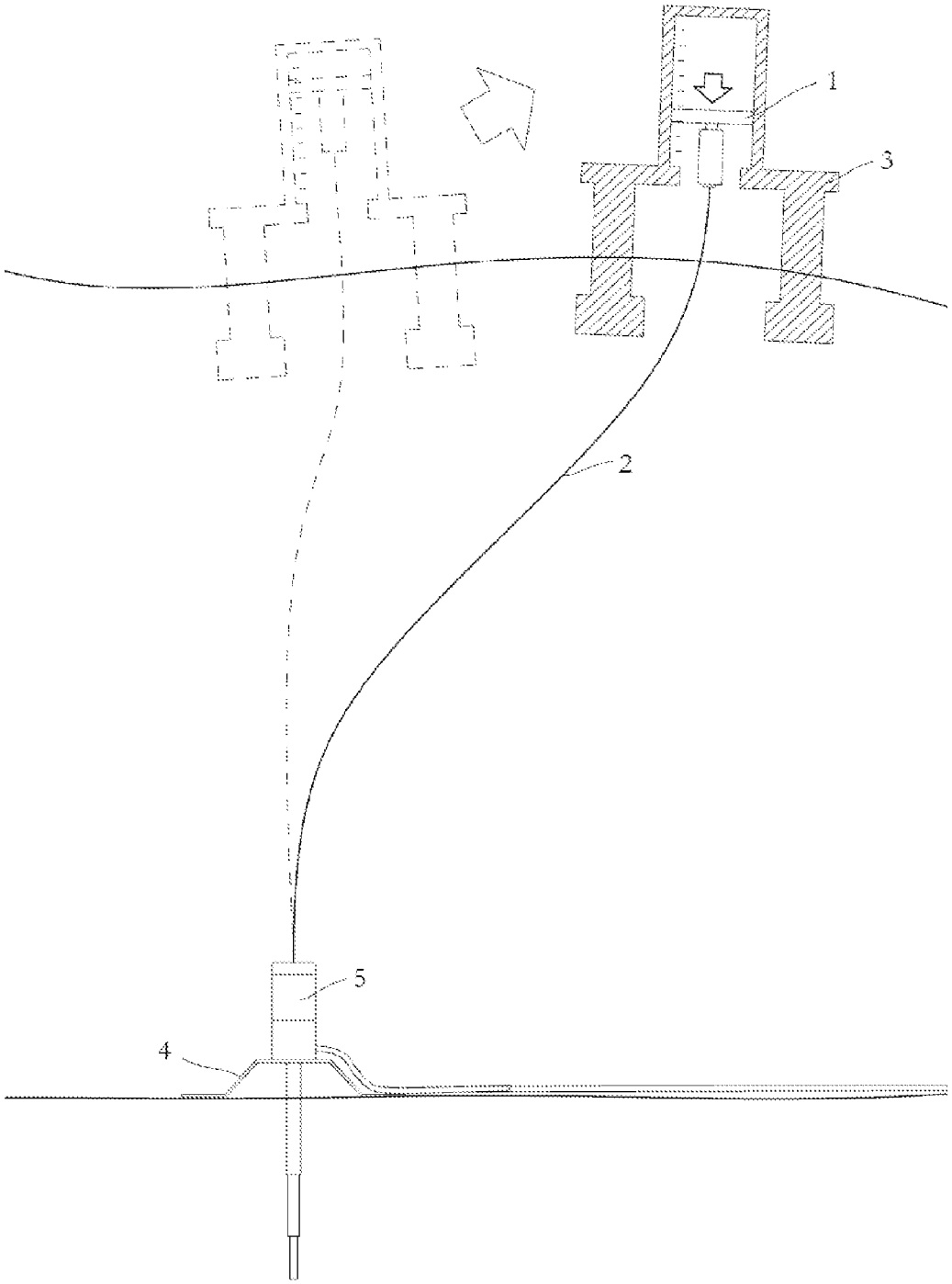
FIG. 3 illustrates the accidental scenario referred to as loss of position (due to loss of an anchor, drive-off or drift off) and how this will cause excessive bending in the well barrier(s) 5 once the heave compensator 1 has stroked out.
Figure 4:
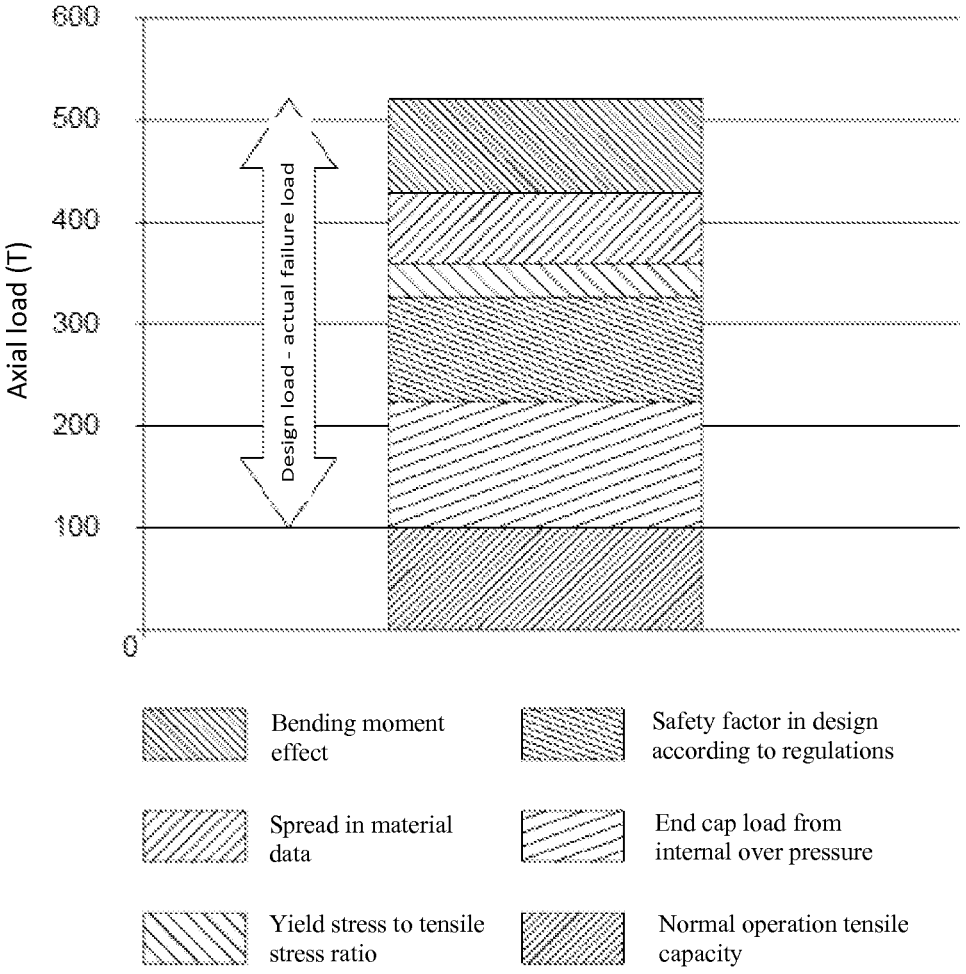

FIG. 4 illustrates the challenge of designing a weak link that fulfills all safety criteria in normal operation, but at the same time ensures a reliable release in an accidental scenario before the well barrier(s) is(are) damaged. The figure illustrates the problem related to the width of the band between the weak link fulfilling all design requirements and the structural failure capacity of the same weak link.

Figure 5:
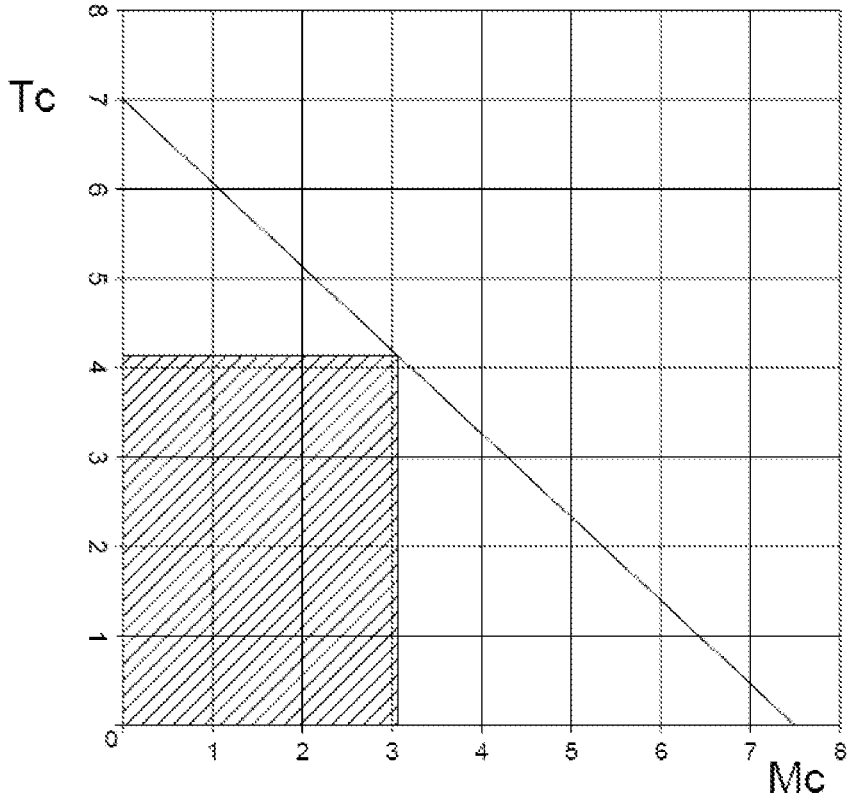

FIG. 5 illustrates a typical defined combined loading capacity curve for well barrier(s) 5. The load capacity curve does not represent an actual break of the well barrier(s), but indicates the design curve that has been used for accidental scenarios where all safety factors have been removed. When the combined load in the well barrier(s) 5 exceeds this curve there is no guarantee for the integrity of the well barrier(s), and there is a significant risk of having damaged the seals or having caused some form of permanent damage to the well barrier(s) 5.

Figure 6:
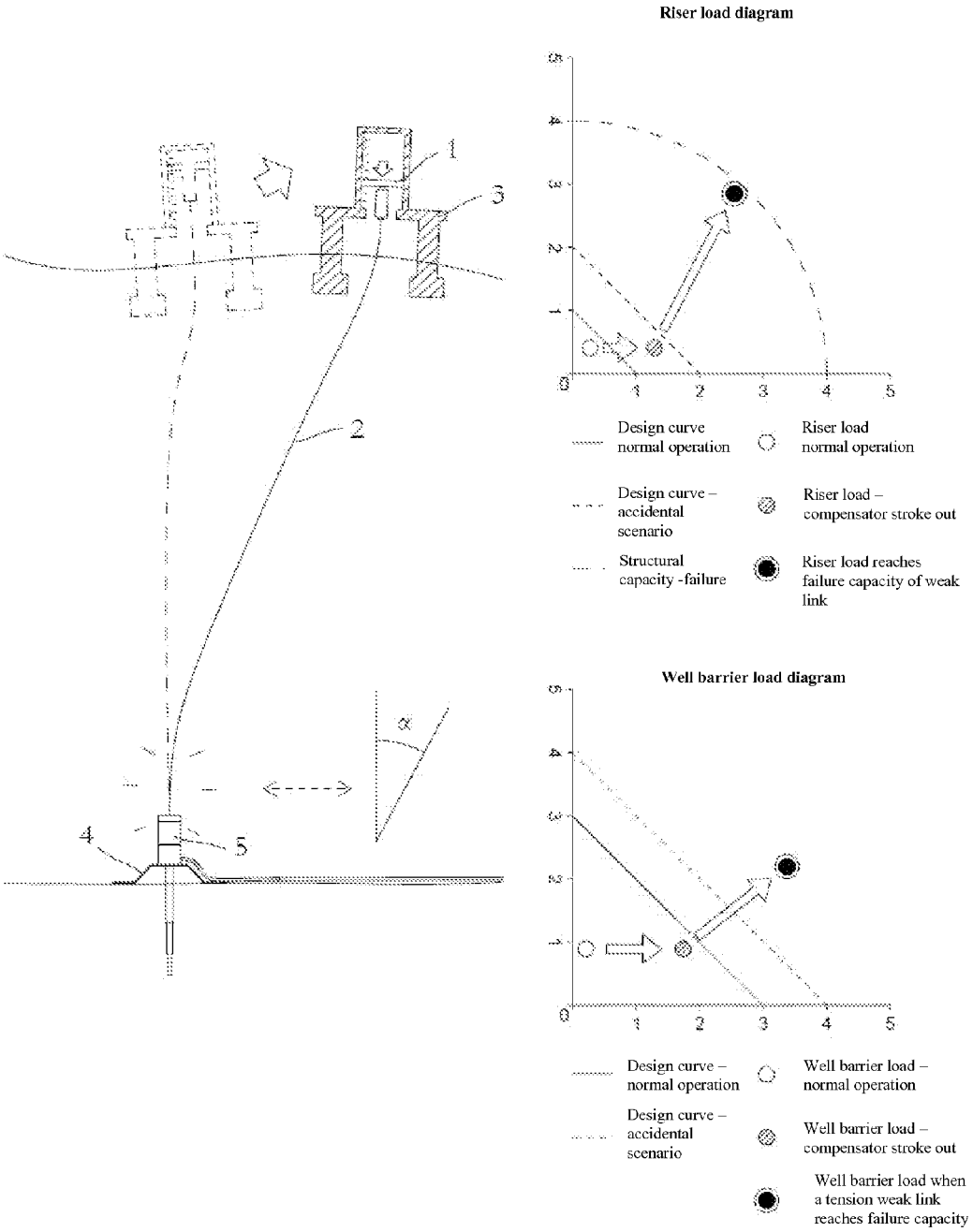

FIG. 6 illustrates the problem of using a weak link based on structural failure in a riser component to protect the well barrier(s) in case of a loss of position accidental scenario. The figure shows how the riser 2 tension remains constant until the heave compensator 1 stroke out. At this point the tension will increase rapidly and the angle $\alpha$ will cause high bending loads in the well barrier(s) 5, causing the load capacity of the well barrier(s) 5 to be exceeded long before reaching the structural failure of the riser weak link designed to fail in tension.

Figure 7:
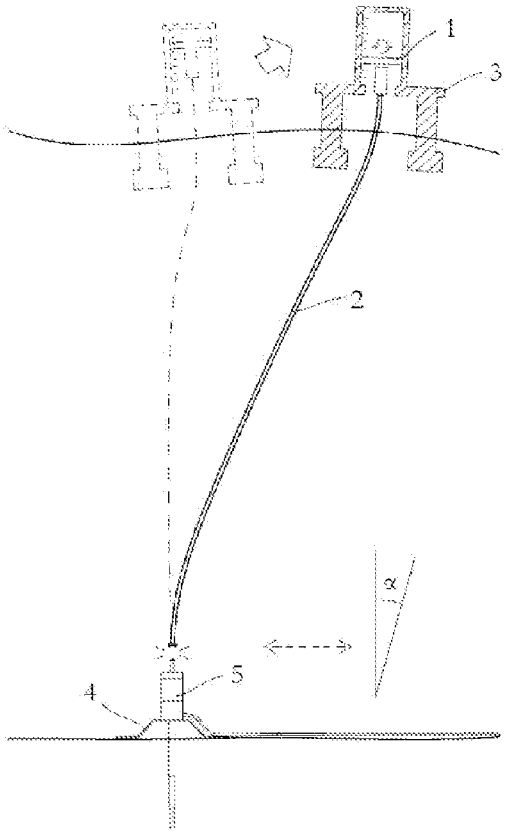
Figure 7:
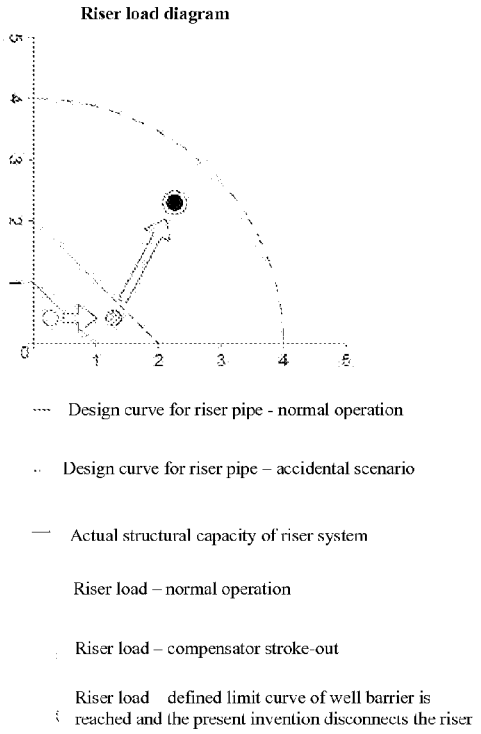
Figure 7:
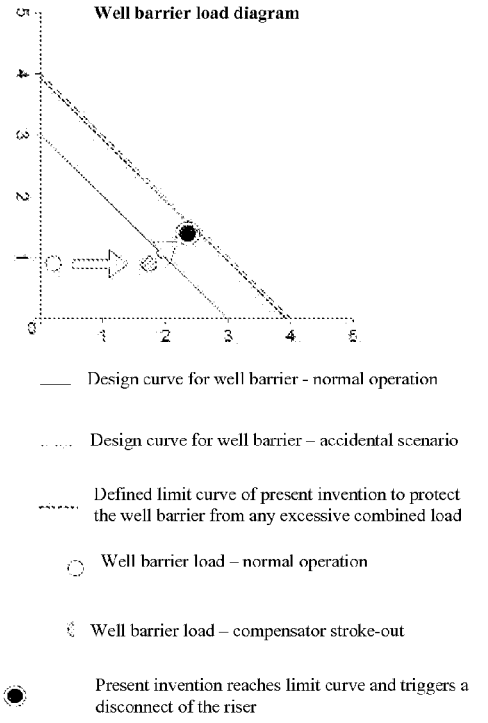

FIG. 7 shows how the present invention would work to protect the well barrier(s) 5 in case of the vessel loosing its position due to a drive-off or drift-off scenario. The figure shows how the bending load capacity of the weak link is defined to be just within the capacity of the well barrier(s) 5. Hence for any bending load induced on the well barrier(s) 5 the invention will ensure a controlled disconnect of the riser 2 before exceeding the capacity curve of the well barrier(s) 5.

Figure 8:
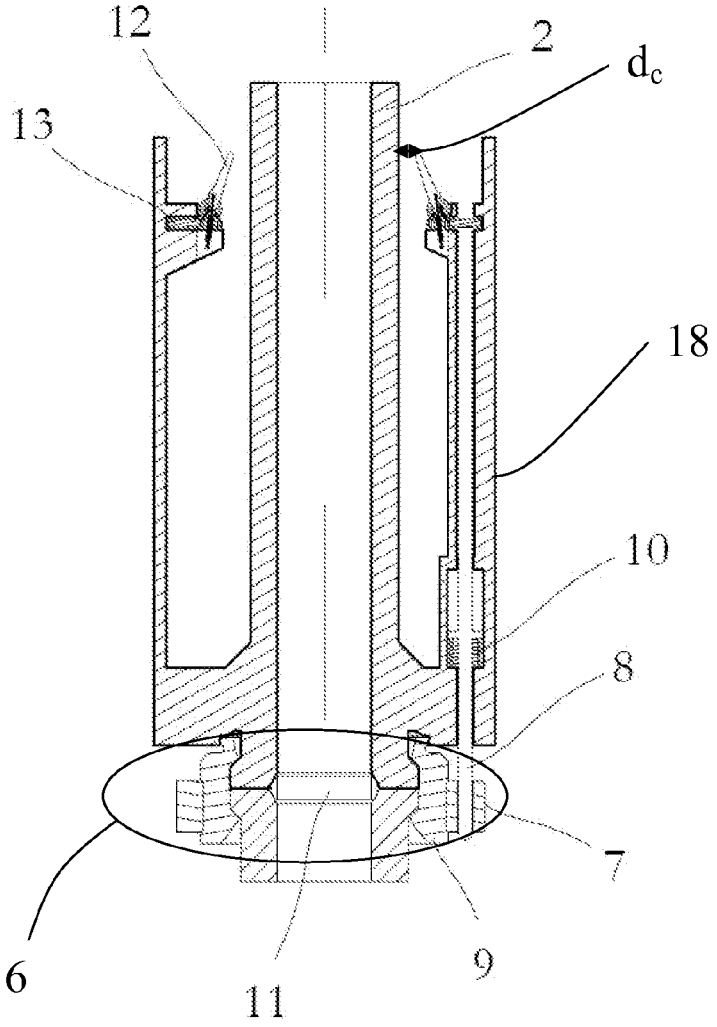

FIG. 8 shows a cross section of an embodiment of the present invention with a disconnectable connector 6, a curvature detection arrangement consisting of a stiff body 18 being rigidly attached to the riser pipe 2 and comprising mechanical trigger mechanism(s) 12 placed at the end of the stiff body 18 and at/with a certain distance from the point of fixation to the riser pipe 2. The limiting bending moment in the riser pipe 2 is detected by the curvature being proportional to the bending moment in the riser pipe 2. As the limiting bending moment is reached the riser pipe curvature will contact the trigger mechanism 12 between the stiff body 18 and the riser pipe 2 and thereby initiate a disconnect of the releasable connector 6.

Figure 9:
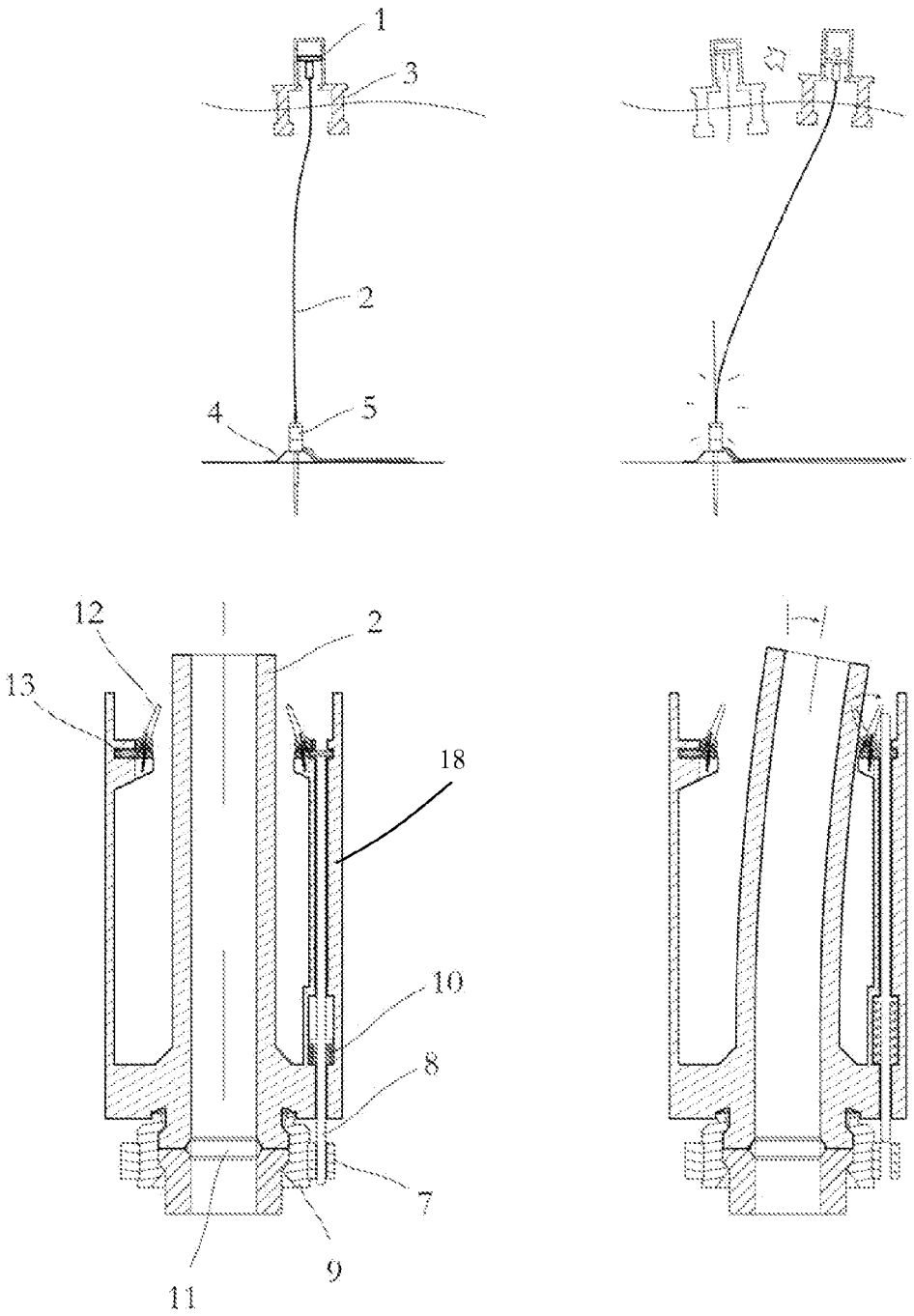

FIG. 9 illustrates how the device works in case of a vessel loss of position scenario where the curvature in the riser pipe will trigger a disconnect of the safety device.

Figure 10:
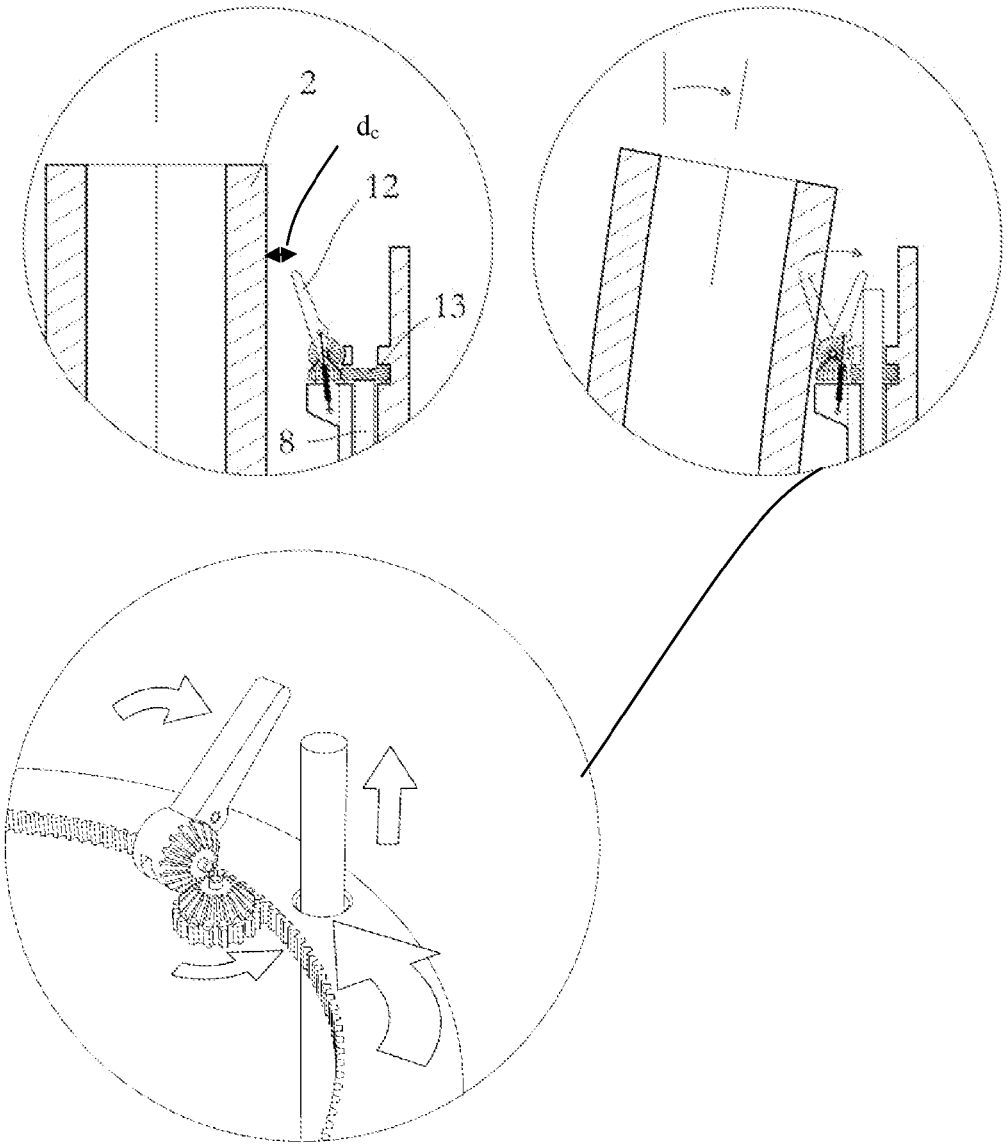

FIG. 10 shows one possible embodiment of the invention with the mechanism for releasing the connector 6 when the curvature in the riser pipe 2 exceeds the predefined limit. The release is triggered by a number of over centre mechanisms 12 that on contact with the riser 2 will flip over, and rotates a rotating locking disk 13. This locking disk 13 secures a spring loaded locking pin 8 which locks the cam or cam ring 7 around the connector. When the riser pipe 2 contacts one or more of the over centre mechanisms or triggers 12, wherein these 12 will flip over, the locking disk 13 will rotate and the spring loaded locking pin 8 is being retracted from the cam ring 7, thereby disconnecting the releasable connector 6.

Figure 11:
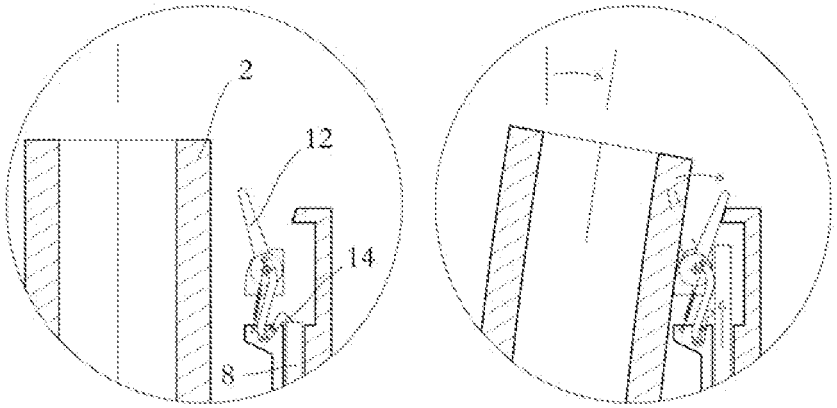
Figure 11:
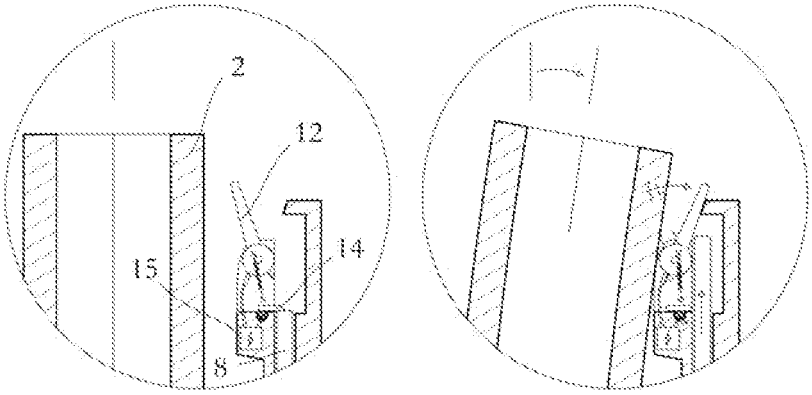
Figure 11:
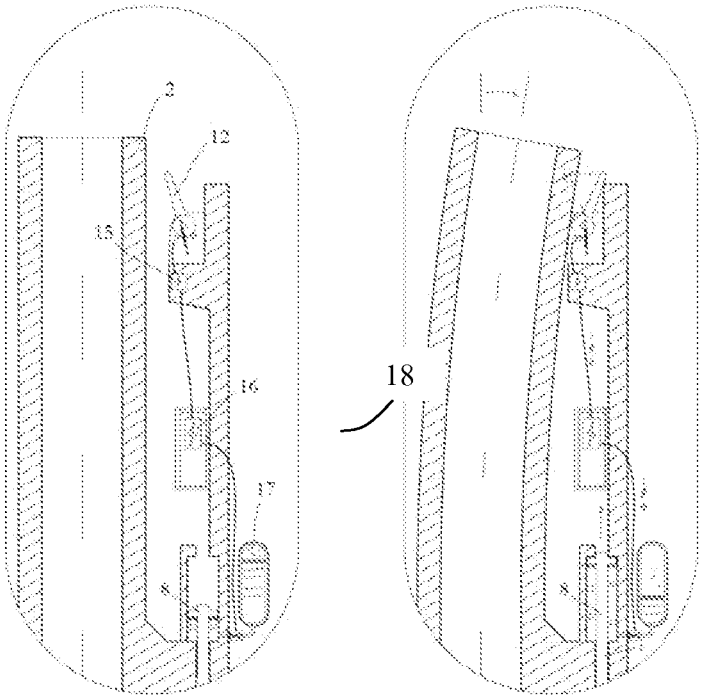

FIGS. 11A-C show alternative configurations of the mechanism(s) for triggering a disconnect of the releasable connector when the curvature in the riser pipe exceeds the pre-defined limit bending moment.

FIG. 11A shows an alternative configuration using of several locking pins 8 around the circumference of the riser pipe 2. In this case each over center mechanism contains a locking device 14 for securing a locking pin 8 directly.

FIG. 11B illustrates another possible embodiment of the invention utilizing over centre mechanism(s) connected to an electric switch which releases the locking pin 8 with an electric actuator 15.

FIG. 11C shows yet another possible embodiment of the invention where the over centre mechanism 12 is connected to an electrical switch 15 which in terms opens a hydraulic valve contacted to an accumulator 17 which hydraulically retracts the locking pin 8 to open the releasable connector.

Figure 12:
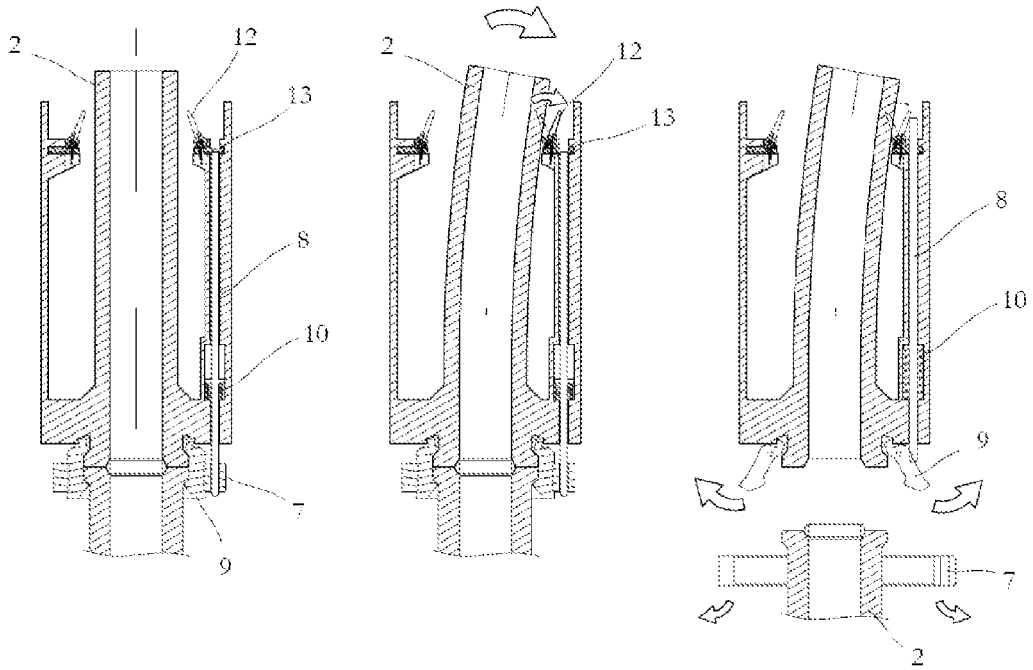

FIG. 12 shows a disconnect sequence of a possible embodiment of the present invention from the point where the curvature in the riser pipe 2 triggers the over centre mechanism(s) 12, the locking disk 13 is rotated and the spring loaded locking pin 8 is released. The spring loaded locking pin 8 is pulled out from the connector's cam ring 7 by the force of the preloaded spring 10. When the locking pin 8 is removed, the cam ring 7 will open due to the tension forces in the system or by using a leaf spring in the cam ring 7. When the cam ring opens the upper and lower part of the pipe hubs in the connector will pull apart as the connector dogs 9 are free to rotate.

Figure 13:
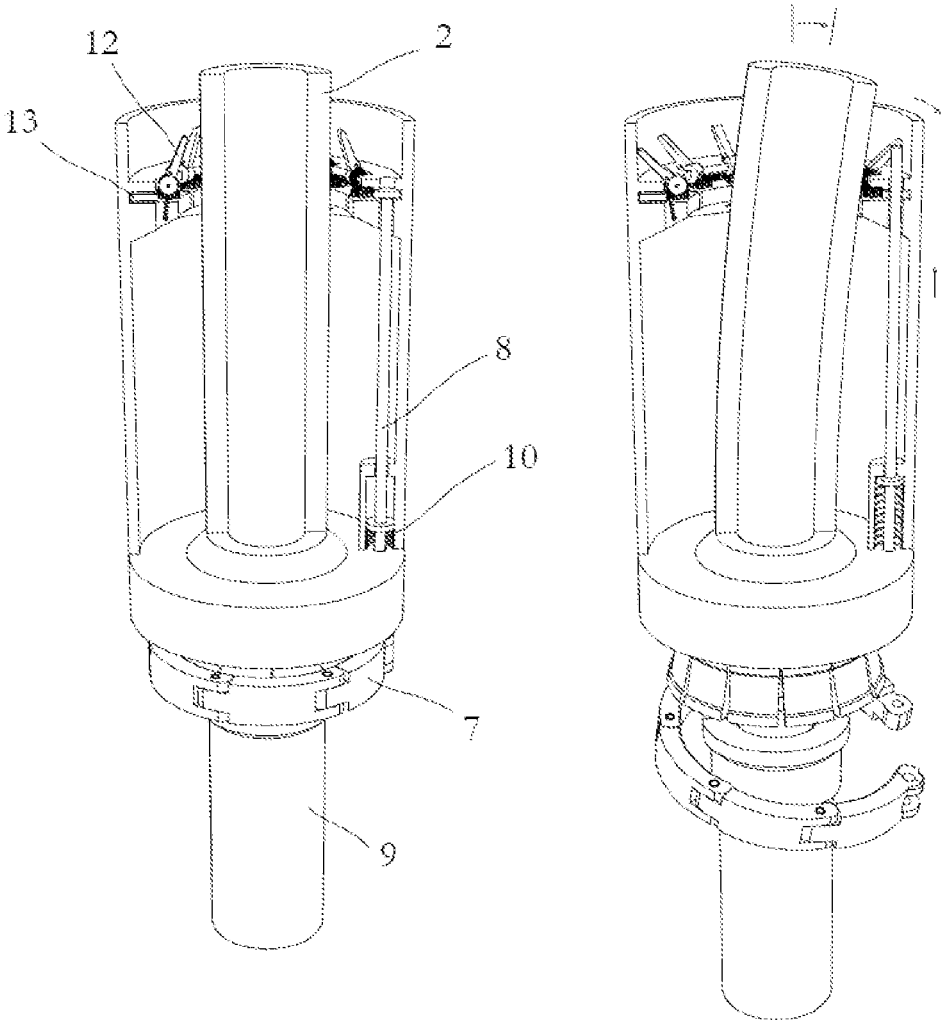

FIG. 13 is a 3D illustration of a disconnect sequence of a possible embodiment of the present invention as described above.

DETAILED DESCRIPTION

The safety device according to the present invention protects the integrity of the riser system including the well barrier(s) 5 against excessive bending loads. In order to fully protect the system against combined loading the device is intended to be used in combination with currently available weak link designs that protect the system against excessive axial forces. Existing weak links typically rely on structural failure of a pipe section or in flange bolts with reduced area, in both cases relying on failure due to high axial forces in the part designed to break. To optimise the design of the weak link and thereby optimize the operational criteria for a workover riser operation it is beneficial to have one weak link designed to protect the riser system only against axial loading, and to have a separate weak link that protects the barrier(s) against excessive bending moments.

In a typical workover riser 2 arrangement the present invention is placed close to the well barrier(s) 5 where the bending moment is close to its maximum and the axial weak link (typically based on existing designs) is placed higher up in the riser 2 section where the main loads in the system are axial.

For other accidental scenarios, like heave compensator lock-up, the existing weak link designs will protect the well barrier(s) 5 from excessive axial loading. The present invention is over dimensioned with respect to axial loading and is therefore un-affected by excessive axial loading.

One embodiment of the present invention comprises a riser pipe section with bending capacity similar to that of the riser pipe 2. The bending in the riser system is detected by a curvature change in a section of the riser pipe 2. In one embodiment of the invention there is a releasable connector 6 below the curvature detection device. When excessive bending in the riser pipe 2 is detected by a trigger mechanism 12, this will trigger a release of the releasable connector 6.

The curvature change is detected by measuring the relative distance between an unloaded stiff body 18 attached to the riser 2 at a certain distance from the point of attachment of the unloaded stiff body, ref. FIGS. 8, 9, 11, 12 and 13. In one embodiment of the invention, the unloaded stiff body 18 is a pipe section outside the riser pipe. However, the stiff body may have any given shape, with any number of corners or it may even be several discrete stiff bodies attached to the riser pipe section 2. Because the stiff body 18 is not exposed to the riser loads, this body will only experience an angular rotation when being exposed to the bending moments of the riser. The load carrying riser 2 will have a stiff body movement which will be identical to that of the unloaded stiff body 18, but will in addition be bent, thereby causing a curvature of the load carrying riser 2 being caused by and being proportional to the bending moment in the riser. Therefore, the change in the distance d between the unloaded stiff body 18 and the load carrying riser pipe 2 at a location with a certain distance from the point of attachment to the riser will give a representation of the bending moment in the riser pipe 2.

The relationship between the riser curvature and the bending moment in the riser 2 is given by:

r=El/M, where;

r=riser radius (mm)

E=the modulus of the steel ($N/mm^2$)

I=is the second moment of inertia ($mm^4$)

M=is the riser moment (Nmm)

As the curvature in the riser pipe 2 inside the stiff body 18 approaches a defined limit which is calculated on a project basis to protect the well barrier(s) 5, the curvature in the riser pipe 2 will cause contact between the pipe section 2 and the unloaded stiff body 18. By arranging for a number of trigger mechanisms 12 around the circumference of the top of the unloaded stiff body 18, means for detecting a critical bending load in or in between the well barrier(s) 5 and/or riser 2 and a predefined critical distance $d_c$ is provided. It is understood that by modifying the trigger mechanism 12 it is also possible to utilise only one trigger mechanism 12 if this holds a ring around the riser pipe, thereby detecting contact in any direction. In such a case the trigger mechanism 12 should be allowed to rotate in any direction. Once the critical bending load and/or the predefined critical distance $d_c$ is reached, means for triggering disconnection of a releasable riser connector 6 may be actuated, thereby releasing the riser 2 from the well barrier(s) 5. According to the present invention, the number of trigger mechanisms advantageously may be higher than 4, and may typically be in the range of 10-12 trigger mechanisms around the circumference of the pipe.

In one possible embodiment of the present invention the trigger mechanisms 12 consist of an over centre mechanism attached to a coned sprocket. When the riser pipe section 2 contacts the trigger mechanism 12, this will flip over centre and the coned sprocket will rotate a locking disk 13 which supports a spring loaded locking pin 8 which is securing a split cam ring 7. When the locking disk 13 is rotated by the trigger mechanism(s) 12, the spring loaded locking pin 8 is released thereby disengaging the releasable connector 6.

To adjust the bending moment that triggers a release of the connector 6, the spacing between the riser pipe section 2 and the trigger mechanism 12 attached to the top of the stiff body 18 is adjusted. A short spacing will indicate a low bending moment to trigger a release, and a greater spacing will indicate a higher bending moment to trigger a release of the connector.

For the section of the riser pipe 2 inside the stiff body 18, the radius along the length of the unloaded pipe 18 will vary as the system stiffness varies. The relationship between riser moment and displacement at the top of the stiff body 18 will be project specific. Project specific analyses are required to calculate the correct distance between the riser pipe 2 and the trigger 12 in order for the weak link to trigger a disconnect of the riser 2 at a certain project specific maximum allowable bending moment.

FIG. 10 shows how other possible embodiments of the present invention may also include the use of several discrete mechanical trigger mechanisms. Alternatively, an electrical switch 15 may be applied to trigger a release of the connector or trigger that initiate a hydraulic 17 release of the connector, ref. FIG. 11B.

The releasable connector 6 can be based on a standard connector principle that is modified with a release mechanism using a hinged and split cam ring 7, and a spring loaded locking pin 8 as illustrated in FIGS. 12 and 13.

The locking pin 8 may also be energized using any sort of hydraulic arrangement. The split cam ring 7 is pre-tensioned to engage connector dogs 9 with sufficient force as for a normal connector design. In order to accommodate a disconnect function the split cam ring 7 is hinged in two or more locations. It is understood that the number of hinges may be higher or lower, for example 3, 4, 5, 6, or any other suitable number. At least one of the hinges is connected by an energized locking pin 8. The locking pin 8 is energized with sufficient force to ensure that the locking pin can be retracted from the split cam ring 7 when this is pre-tensioned to it maximum design load. According to one embodiment the locking pin 8 is energized by a loaded mechanical spring 10. Alternatively a pressurized hydraulic system with electronically actuated valves may equally well be used. Pure electric retraction of the locking pin 8 may be another option. The locking pin 8 holds the split cam ring 7 together as long as the locking pin 8 is in place. In order to disconnect the riser 2, the locking pin 8 in the split cam ring 7 is released by releasing the mechanical spring 10, alternatively by opening a hydraulic valve, or any other suitable method for retracting the locking pin 8. The locking pin 8 is then pulled out and cleared from the split cam ring 7, which will then open up due to the tension forces in the system. The connector dogs 9, which hold the flanges of two riser sections together, are then free to rotate, and the tension in the riser 2 will ensure that the flange faces 11 of the riser sections are pulled apart, and the riser 2 is disconnected from the well. Radial springs (not shown) may be incorporated into the split cam ring 7 in order to ensure that the split cam ring 7 opens up when the locking pin 8 is retracted. It is understood that a releasable latching mechanism (not shown) may be used instead of locking pin 8.

FIGS. 12 and 13 illustrate possible disconnect sequences.

In the case that the change in curvature in the riser pipe 2 is detected by means of an over centre mechanism 12 which will flip over by the touch of the riser pipe 2, the over centre mechanism may be placed on the load carrying riser pipe 2 or on the unloaded stiff body 18 or in any other suitable location where a change in the riser pipe curvature may cause a displacement to flip the over center mechanism.

According to the present invention, various kinds of detection means for detecting $d_c$ may be utilized. In addition to mechanical detection means, optical or electronic detection means may be utilized. An optical or electronic signal may then be used to actuate the trigger mechanism.

Possible advantages of the present invention can be summarized as:

The need for well barrier(s) 5 protection against excessive bending load will typically be caused by accidental scenarios where vessel loss of position occurs. The invention will in combination with existing weak link designs protect the well barrier(s) 5 against any accidental scenario creating excessive axial forces and excessive bending moments that may otherwise have been damaging to the well barrier(s) 5. In addition, the operating envelope of the riser and well barrier(s) may be increased significantly because the functionality of the bending moment weak link and the axial tension force weak link are separated and thereby do not affect each other.

According to one aspect of the method and safety device according to the present invention, the bending moment limit of the safety device can be adjusted to accommodate use of one safety device in several different riser systems 2 with different bending capacities. The adjustment of the bending moment limit can be done by adjusting the space between the unloaded stiff body 18 and the load carrying riser pipe 2, and/or the location of where the trigger arrangement is attached. The trigger mechanism may be arranged on the load carrying riser pipe 2 and/or on the unloaded stiff body 18, and it is understood that one may adjust the distance between the trigger mechanism from either side or from both sides.

According to a further aspect of the present invention, the appropriate spacing between the load carrying riser pipe 2 and the unloaded stiff body 18 may be determined on a project basis by evaluating the relationship between the bending moment(s) in the load carrying riser pipe 2 versus the limiting moment(s) in the well barrier(s) 5.

According to the present invention, the curvature of the load carrying riser pipe 2 may, as previously mentioned, be measured by monitoring the relative distance d between the load carrying riser pipe 2 and an unloaded stiff body 18. One end of the unloaded stiff body 18 may according to the present invention be attached to the load carrying riser pipe 2. A bending moment in the load carrying riser 2 will cause a stiff body rotation as well as a curvature in the load carrying riser pipe 2, whereas the curvature of the load carrying riser pipe 2 will be substantially proportional to the moment in the load carrying riser pipe 2. The relationship between the moment in the load carrying riser pipe 2 and the bending moment on the well barrier(s) 5 or any other critical system component may then be utilized to determine the limiting moment of the load carrying riser pipe 2. The unloaded stiff body 18 which at one end is attached to the riser, will follow the stiff body movement of the riser string due to bending, whereas the curvature in the riser pipe caused by the bending moment will not occur in the stiff body 18 as it is unloaded. Therefore, the relative displacement or the distance d between the stiff body and the load carrying riser pipe 2 gives a proportional measure of the bending moment in the riser pipe.

The bending weak link according to the present invention is non-destructive, thus allowing for simple multiple testing to document reliability and accurate release load. Qualification time for the weak link for any given project will be reduced significantly compared to designs that rely on structural failure of load carrying parts.

Possible advantages and improvements over prior art can be summarized as: Existing weak links are designed to fail in tension and they are therefore suitable for protecting well barrier(s) 5 against accidental scenarios involving high axial loads. For scenarios involving high bending, typically because the riser tension is applied at an angle, the existing weak link design cannot protect the well barrier(s) against the excessive bending loads. The present invention is designed to protect the well barrier(s) against excessive bending loads. Existing weak link designs typically rely on structural failure of a component. The present invention is designed with a releasable connector 6 which is over dimensioned. The release limit is adjustable from project to project thereby saving significant time and cost for project specific qualification of a weak link.

It is understood that a bending weak link according to the present invention may be used for riser systems during drilling after the BOP is landed on the seabed, during well intervention operations, and during completion and workover operations. The person skilled in the art will also understand that a bending weak link according to the present invention may be used for offloading hoses and other riser applications both rigid and flexible.

The invention claimed is:

1. A safety device for protection of well barrier(s) against excessive bending moments from a riser, wherein the safety device is arranged to detect critical bending loads in or in between the well barrier(s) and/or riser, the safety device comprising:

a curvature detection arrangement configured to detect changes in a curvature between a load carrying riser pipe and an unloaded stiff body attached to or in the vicinity of the riser pipe, said curvature detection arrangement being arranged to monitor a relative distance between the load carrying riser pipe and the unloaded stiff body, a trigger mechanism configured to trigger disconnection of a releasable riser connector when the distance between the load carrying riser pipe and the unloaded stiff body reaches a predefined critical distance, wherein said trigger mechanism is a mechanical trigger comprising an over center mechanism which is arranged to flip over by the touch of the riser pipe.

2. The safety device according to claim 1, wherein the over center mechanism is arranged to be rotated thus rotating a locking disc which allows a release of a spring loaded locking pin holding together the riser connector.

3. The safety device according to claim 2, wherein the mechanical trigger comprises an electric switch which upon contact with the riser pipe automatically is arranged to start an electric actuator that initiates a disconnect sequence of the releasable connector.

4. The safety device according to claim 3, wherein the unloaded stiff body comprises a number of discrete bodies attached to the riser pipe section.

5. The safety device according to claim 3, wherein the curvature detection arrangement and the trigger mechanism are located on the unloaded stiff body, the load carrying riser pipe, or a combination of both.

6. The safety device according to claim 2, wherein the unloaded stiff body comprises a number of discrete bodies attached to the riser pipe section.

7. The safety device according to claim 2, wherein the curvature detection arrangement and the trigger mechanism are located on the unloaded stiff body, the load carrying riser pipe, or a combination of both.

8. The safety device according to claim 1, wherein the over center mechanism is arranged to be rotated thus opening a hydraulic valve, thereby freeing the pressure in a hydraulic accumulator which is arranged to hydraulically push out a hydraulic locking pin holding together the riser connector.

9. The safety device according to claim 8, wherein the unloaded stiff body comprises a number of discrete bodies attached to the riser pipe section.

10. The safety device according to claim 8, wherein the curvature detection arrangement and the trigger mechanism are located on the unloaded stiff body, the load carrying riser pipe, or a combination of both.

11. The safety device according to claim 1, wherein the unloaded stiff body comprises a number of discrete bodies attached to the riser pipe section.

12. The safety device according to claim 11, wherein the curvature detection arrangement and the trigger mechanism are located on the unloaded stiff body, the load carrying riser pipe, or a combination of both.

13. The safety device according to claim 1, wherein the curvature detection arrangement and the trigger mechanism are located on the unloaded stiff body, the load carrying riser pipe, or a combination of both.

14. A method for protection of well barrier(s) against excessive bending moments from a riser, the method comprising the steps of:

detecting changes in a curvature between a load carrying riser pipe and an unloaded stiff body attached to or in the vicinity of the riser pipe, triggering disconnection of a releasable riser connector when the distance between the load carrying riser pipe and the unloaded stiff body reaches a predefined critical distance, wherein said step of triggering comprises using a mechanical trigger comprising an over center mechanism which is arranged to flip over by the touch of the riser pipe.

15. The method according to claim 14, wherein a disconnect sequence of the releasable connector is initiated when the distance between the load carrying riser pipe and the unloaded stiff body reaches a predefined critical distance, the disconnect sequence comprising the step of releasing a spring loaded locking pin holding together the riser connector.

16. The method according to claim 14, wherein a disconnect sequence of the releasable connector is initiated when the distance between the load carrying riser pipe and the unloaded stiff body reaches a predefined critical distance, the disconnect sequence comprising the step of opening a hydraulic valve, thereby freeing the pressure in a hydraulic accumulator which will hydraulically push out a hydraulic locking pin holding together the riser connector.

* * * * *